US005983795A

United States Patent [19]

Stein et al.

[11] Patent Number: 5,983,795

[45] Date of Patent: Nov. 16, 1999

[54] SHEET-FED ROTARY PRINTING PRESS

[75] Inventors: Lothar Stein, Hirschberg; Frank Schaum, Neckargemünd, both of Germany

[73] Assignee: Heidelberger Druckmaschinen AG, Heidelberg, Germany

[21] Appl. No.: 09/033,140

[22] Filed: Mar. 2, 1998

[30] Foreign Application Priority Data

Mar. 1, 1997 [DE] Germany ..... 197 08 434

[51] Int. Cl.[6] ..... B41F 7/02

[52] U.S. Cl. ..... 101/218; 101/351.1; 101/352.01; 118/46; 118/224

[58] Field of Search ..... 101/216, 218, 101/139, 322, 348, 349.1, 351.1, 352.01, 361, 362, 182, 184, 185; 118/46, 211, 224

[56] References Cited

U.S. PATENT DOCUMENTS

| | | | |
|---|---|---|---|
| 3,611,921 | 10/1971 | Jahn | 101/77 |
| 4,721,041 | 1/1988 | Simeth | 101/230 |
| 4,779,557 | 10/1988 | Frazzitta | 118/46 |
| 4,833,984 | 5/1989 | Bolza-Schunemann et al. | 101/220 |
| 4,841,903 | 6/1989 | Bird | 118/46 |
| 5,156,638 | 10/1992 | Wirz | 101/142 |
| 5,178,678 | 1/1993 | Koehler et al. | 118/46 |
| 5,259,308 | 11/1993 | Wirz | 101/230 |
| 5,651,316 | 7/1997 | DeMoore et al. | 101/450.1 |

FOREIGN PATENT DOCUMENTS

| | | |
|---|---|---|
| 0664212A1 | 7/1995 | European Pat. Off. . |
| 3413158C2 | 2/1986 | Germany . |
| 3525743A1 | 1/1987 | Germany . |
| 9206416 | 8/1992 | Germany . |
| 4128864C2 | 10/1994 | Germany . |
| 19514259A1 | 10/1996 | Germany . |
| 2150079 | 6/1985 | United Kingdom . |

*Primary Examiner*—Ren Yan
*Assistant Examiner*—Dave A. Ghatt
*Attorney, Agent, or Firm*—Herbert L. Lerner; Laurence A. Greenberg

[57] ABSTRACT

A sheet-fed rotary printing press having at least one printing unit with an impression cylinder includes a transfer cylinder assigned to the impression cylinder for onwardly transporting sheets printed thereby, the transfer cylinder having at least one gripper system and being formed with a cylinder-jacket surface assigned thereto, the surface being rigid and a full surface, and at least one unit of a varnishing, a numbering and an imprinting unit assigned to the transfer cylinder.

4 Claims, 1 Drawing Sheet

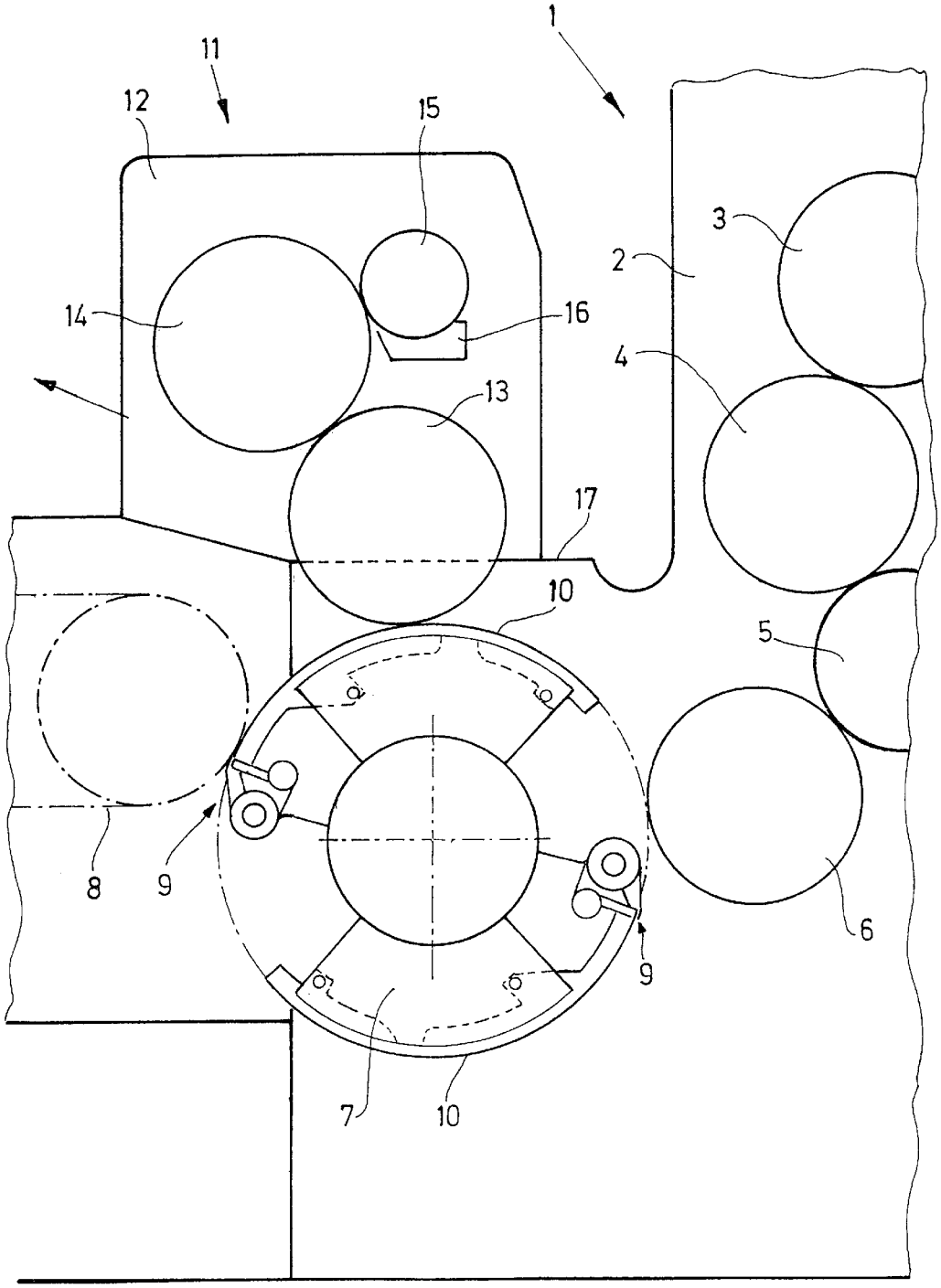
1
11
12
15
3
2
14
16
4
13
17
10
5
8
9
6
9
7
10

SHEET-FED ROTARY PRINTING PRESS

BACKGROUND OF THE INVENTION

Field of the Invention

The invention relates to a sheet-fed rotary printing press and, more particularly, to such a printing press having at least one printing unit with an impression cylinder to which a transfer cylinder for transporting sheets printed thereby is assigned, the transfer cylinder having at least one gripper system with an assigned cylinder jacket surface.

In such sheet-fed rotary printing presses, the sheets which are to be printed are transported by transfer drums from printing unit to printing unit and, at the end of the press, also via such cylinders, are fed to a delivery chain system. For special printing jobs, such as, for package printing, for example, customers want the printed sheets to be varnished, for example, in order to achieve a higher gloss. For other printing jobs, for example, consecutive numbers must be imprinted, or it is necessary to print a decorative color, for example. These additional jobs should be performable as much as possible without great expenditures in construction and without high costs. It would also be advantageous if a printing press could subsequently be changed over or convertible so as to perform such additional jobs.

SUMMARY OF THE INVENTION

Taking the foregoing into consideration, it is accordingly an object of the invention to provide a sheet-fed rotary printing press which is relatively easily convertible so that it is able to perform these special jobs.

With the foregoing and other objects in view, there is provided, in accordance with the invention, a sheet-fed rotary printing press having at least one printing unit with an impression cylinder, comprising a transfer cylinder assigned to the impression cylinder for onwardly transporting sheets printed thereby, the transfer cylinder having at least one gripper system and being formed with a cylinder-jacket surface assigned thereto, the surface being rigid and a full surface, and at least one unit of a varnishing, a numbering and an imprinting unit assigned to the transfer cylinder.

In accordance with another feature of the invention, the varnishing, the numbering and the imprinting units have frame parts at both sides thereof and are seatable as attachments on connecting surfaces on the respective printing unit.

In accordance with a further feature of the invention, the varnishing, the numbering and the imprinting units, respectively, are displaceably mounted on connecting surfaces formed on a respective printing unit.

In accordance with a an added feature of the invention, the varnishing, the numbering and the imprinting units, respectively, are constructed so as to be removable and exchangeable.

In accordance with a concomitant feature of the invention, the impression cylinder of the respective printing unit has a given size, and the varnishing, the numbering and the imprinting units, respectively, have a transfer cylinder assigned thereto which is double the size of the impression cylinder, the transfer cylinder having rigid and full-surface jacket surfaces which are exchangeable.

The connecting surfaces described hereinbefore can be provided beforehand on the printing units, so that even afterwards a special unit for performing the additional or auxiliary work can be installed. The drive of such a varnishing, numbering or imprinting unit can be derived from the conventional spur-gear drive of the transfer drum.

In an advantageous construction of the press according to the invention, the respective varnishing, numbering and imprinting units are mounted so as to be displaceable on the connecting surfaces in order to be able to perform adjustment or maintenance work.

In a further advantageous construction, the varnishing, numbering or imprinting unit is removable and exchangeable. The pressman or other operating personnel can thereby, for example, exchange a varnishing unit for a numbering unit if he or she is printing a corresponding job on the printing press. The sheet-fed rotary printing press can thereby be installed considerably more flexibly, and is able to complete multi-sided printing jobs without requiring auxiliary installations or assemblies.

In accordance with a further construction of the invention, the varnishing, numbering or imprinting unit is assigned to a transfer drum having a size which is double that of the conventional printing-unit cylinders such as the plate cylinder, for example. With such a transfer drum, for example, rigid, full-surface jacket surfaces can be installed when necessary so that the use of the individual units can be optimized.

Other features which are considered as characteristic for the invention are set forth in the appended claims.

Although the invention is illustrated and described herein as embodied in a sheet-fed rotary printing press, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying single FIGURE of the drawing, which is a fragmentary diagrammatic side elevational view of the sheet-fed rotary printing press constructed in accordance with the invention.

DESCRIPTION OF THE PREFERRED EMBODIMENTS

Referring now to the FIGURE of the drawing, there is shown therein a printing unit 1 of a sheet-fed rotary printing press having side frames 2 between which a plate cylinder 3, a rubber blanket cylinder 4, and an impression cylinder 5 are mounted in a conventional manner. Printed sheets are transported onward from the impression cylinder 5 by transfer drums 6 and 7 and, in the illustrated exemplary embodiment, are transferred to a chain delivery system 8. In the illustrated embodiment, the transfer drum 7 is provided with two gripper systems 9 with assigned cylinder-jacket surfaces 10. The sheet to be transported deposits on the jacket surfaces 10 so that these surfaces also serve as support surfaces.

In the illustrated embodiment, a varnishing unit 11 is assigned to the transfer drum 7 and includes an oilcloth cylinder 13, a transfer roller 14, a dip roller 15 and a varnish pan or bath 16, all of which are mounted between opposing frame parts 12. The oilcloth cylinder 13 transfers varnish to the sheet which has been fed onto the jacket surface 10 of the transfer drum 7. In order to be able to perform trouble-free varnishing, numbering or imprinting, the jacket surface 10 is made rigid and full surface. The jacket surface 10 can also be exchangeably fastened onto the transfer drum 7 in order to adjust it to the respective jobs. It is advantageous for the transfer drum 7 to be twice the size of the regular printing-unit cylinders, namely, the plate, the blanket and the impression cylinders, because then, two gripper systems 9 may be provided on the transfer drum 7, so as to be able to transport two sheets on the circumference thereof. The diameter of the transfer drum 7 is accordingly twice as long as the diameter of any of the printing-unit cylinders, such as the plate cylinder 3, for example.

The varnishing unit 11 can be placed with the frame parts 12 thereof on connecting surfaces 17 and fastened thereat. The connecting surfaces 17 can be constructed so that the varnishing unit 11 is movable thereon in order to be able to perform adjustment or maintenance work, for example.

In this regard, the varnishing unit 11 can be removed obliquely upwardly in the direction of the arrow shown associated therewith in the FIGURE of the drawing. It is furthermore possible to construct the varnishing unit 11 so that it is removable and exchangeable, respectively, in order thereby to be able to install a varnishing unit, a numbering unit or an imprinting unit on the connecting surfaces 17 in accordance with the particular need therefor. In this regard, the numbering unit would, in a conventional manner, have a numbering cylinder with an inking unit assigned thereto, and the imprinting unit, a printing form cylinder also with an assigned inking unit.

We claim:

1. A sheet-fed rotary printing press having at least one printing unit with an impression cylinder, comprising a transfer cylinder rotationally aligned with the impression cylinder for onwardly transporting sheets printed thereby, said transfer cylinder having an outer surface, at least one gripper system, and having a cylinder-jacket surface disposed on said outer surface, said cylinder-jacket surface being rigid and fully covering said outer surface, and at least one removable unit selected from the group consisting of a varnishing unit, a numbering unit, and an imprinting unit, said at least one removable unit selected from the group being exchangeable with another said at least one removable unit selected from the group, said at least one removable unit having a cylinder rotationally cooperating with said transfer cylinder.

2. The press according to claim 1, wherein the printing unit has connecting surfaces formed thereon, and said at least one removable unit has frame parts at both sides thereof that are seatable as an attachment on the connecting surfaces formed on the printing unit.

3. The press according to claim 1, wherein the printing unit has connecting surfaces formed thereon, and said at least one removable unit is displaceably mounted on the connecting surfaces formed on the printing unit.

4. A sheet-fed rotary printing press, comprising:

a frame with a connecting surface;

a transfer cylinder rotationally mounted within said frame and having an outer surface and a gripper system for transporting sheets;

a cylinder-jacket surface for performing at least one function selected from the group consisting of varnishing, numbering, and imprinting sheets, said cylinder-jacket surface being rigid, disposed on and fully covering said outer surface of said transfer cylinder; and at least two units selected from the group consisting of a varnishing unit, a numbering unit, and an imprinting unit;

said at least two units removably fastened to said connecting surface of said frame; and each of said at least two units selected from the group being exchangeable with another unit selected from the group.

* * * * *